US011377281B2

(12) United States Patent
Cassoli et al.

(10) Patent No.: US 11,377,281 B2
(45) Date of Patent: Jul. 5, 2022

(54) PACKAGING ARRANGEMENT FOR CANS

(71) Applicant: ECOCAP'S S.r.l., Casalecchio di Reno (IT)

(72) Inventors: Stefano Cassoli, Casalecchio di Reno (IT); Jacopo Cassoli, Casalecchio di Reno (IT)

(73) Assignee: ECOCAP'S S.r.l., Province of Bologna (IT)

( * ) Notice: Subject to any disclaimer, the term of this patent is extended or adjusted under 35 U.S.C. 154(b) by 0 days.

(21) Appl. No.: 16/973,001

(22) PCT Filed: Jun. 10, 2019

(86) PCT No.: PCT/IB2019/054808
§ 371 (c)(1),
(2) Date: Dec. 7, 2020

(87) PCT Pub. No.: WO2019/239280
PCT Pub. Date: Dec. 19, 2019

(65) Prior Publication Data

US 2021/0253323 A1 Aug. 19, 2021

(30) Foreign Application Priority Data

Jun. 13, 2018 (IT) ..... 202018000002751

(51) Int. Cl.
*B65D 71/20* (2006.01)
*B65D 71/58* (2006.01)
*B65D 71/36* (2006.01)

(52) U.S. Cl.
CPC ..... *B65D 71/20* (2013.01); *B65D 71/0022* (2013.01); *B65D 71/36* (2013.01);
(Continued)

(58) Field of Classification Search
CPC .... B65D 71/20; B65D 71/0022; B65D 71/36; B65D 2571/00277; B65D 2571/0029; B65D 2571/0066
See application file for complete search history.

(56) References Cited

U.S. PATENT DOCUMENTS 2,737,326 A * 3/1956 Toensmeier ..... B65D 71/48 294/87.2
2,811,250 A * 10/1957 Arneson ..... B65D 71/30 206/428

(Continued)

FOREIGN PATENT DOCUMENTS

| | | |
|---|---|---|
| BE | 702470 A | 1/1968 |
| DE | 9306653 U1 | 6/1993 |
| FR | 2659624 A1 | 9/1991 |

OTHER PUBLICATIONS

Patent Cooperation Treaty, International Search Report and Written Opinion for International Application No. PCT/IB2019/054808, dated Sep. 26, 2019, 7 pages.

*Primary Examiner* — Jacob K Ackun
(74) *Attorney, Agent, or Firm* — Stetina Brunda Garred and Brucker

(57) ABSTRACT

The invention concerns a tin packaging arrangement comprising a sheet of foldable material folded around a plurality of tins, which are arranged together in an orderly manner for the relative packaging, to form a containment volume for the tins themselves, said volume being substantially defined by a base, a side surface, and a top cover obtained from the sheet in a continuous way. A peculiarity of the present invention is that openings are made in the top cover of the sheet of the packaging arrangement, within which top portions of the tins engage.

4 Claims, 2 Drawing Sheets

(52) U.S. Cl.
CPC ..... *B65D 2571/0029* (2013.01); *B65D 2571/0066* (2013.01); *B65D 2571/00277* (2013.01)

(56) References Cited

U.S. PATENT DOCUMENTS

| | | | | | |
|---|---|---|---|---|---|
| 2,950,041 | A * | 8/1960 | Stone | B65D 71/32 | 206/147 |
| 3,302,784 | A * | 2/1967 | Copping | B65D 71/42 | 206/153 |
| 3,394,800 | A * | 7/1968 | Brackett | B65D 71/38 | 206/196 |
| 3,528,697 | A * | 9/1970 | Wood | B65D 71/46 | 294/87.2 |
| 3,866,818 | A * | 2/1975 | Smith | B65D 71/10 | 206/427 |
| 4,836,375 | A * | 6/1989 | Schuster | B65D 71/16 | 206/427 |
| 4,880,115 | A * | 11/1989 | Chaussadas | B65D 71/50 | 206/427 |
| 4,941,624 | A * | 7/1990 | Schuster | B65D 71/36 | 229/117.13 |
| 5,524,756 | A * | 6/1996 | Sutherland | B65D 71/16 | 206/434 |
| 5,553,705 | A * | 9/1996 | Bakx | B65D 71/40 | 206/158 |
| 5,609,247 | A * | 3/1997 | Appleton | B65D 71/504 | 206/150 |
| 6,039,181 | A * | 3/2000 | Whiteside | B65D 71/125 | 206/427 |
| 8,443,968 | B2 * | 5/2013 | De Paula | B65D 71/42 | 206/153 |
| 2004/0007480 | A1 * | 1/2004 | Pattee | B65D 73/0042 | 206/199 |
| 2006/0207905 | A1 | 9/2006 | Whiteside | | |

* cited by examiner

PACKAGING ARRANGEMENT FOR CANS

CROSS-REFERENCE TO RELATED APPLICATIONS

This application claims priority to PCT International Application No. PCT/IB2019/054808 filed on Jun. 10, 2019, which application claims priority to Italian Patent Application No. 202018000002751 filed on Jun. 13, 2018, the disclosures of which are expressly incorporated herein by reference.

STATEMENT RE: FEDERALLY SPONSORED RESEARCH/DEVELOPMENT

Not applicable.

BACKGROUND

The present invention concerns an arrangement for packaging a plurality of tins into so-called cluster packs, in particular exclusively for packaging tins.

In the field, it is known to package tins by providing a sheet of material suited for the purpose, typically made of card and/or cardboard, shaped and folded in such a way as to contain, within a volume defined by the folding, a plurality of tins arranged together in an orderly manner close to one another, and by substantially covering the base, the top surface and part of the side surface of some tins with the sheet, thus ensuring corresponding assemblage thereof for subsequent transport and storage. The aforesaid sheet is typically tacked at its ends at the end of the corresponding folding operations in such a way as to define said volume within which the tins are stably packed. Such a packaging arrangement does not guarantee a great deal of stability of the tins arranged therein; it is possible for them to move around in the gaps defined by said volume. There is consequently felt the need to provide a particularly tight package, with the cardboard sheet that adhering to the tins, and this calls for a considerable precision in implementation of the corresponding packaging method, which must be carried out using machinery that guarantees a good processing precision and is hence costly. The top part of the tin is moreover covered, so that it is not visible from outside.

It is known to box a plurality of tins within boxes substantially constituted by a pair of half-shells facing one another that are typically made of the same materials referred to previously, which at times leave exposed to view only part of the side section of some of the packaged tins. In such solutions, the tins are almost completely invisible from outside.

Other solutions envisage packaging arrangements constituted by a film of transparent plastic material designed to grip in a continuous way each individual body of a plurality of tins typically arranged in one or more orderly rows, the film gripping the tin typically in the proximity of the top part of the corresponding body. The transparent film thus holds the tins together, enabling a simple grouping thereof to facilitate their storage and transport. These arrangements substantially leave exposed and unprotected the entire outer surface of the tins, thus completely exposing them to external agents such as dust and dirt, which can thus accumulate during storage and transport.

BRIEF SUMMARY

The aim of the present invention is to overcome the drawbacks of the prior art mentioned above and to propose an arrangement for packaging tins that will guarantee a good stability of the packaged tins, at the same time, leaving the side surface and the top part thereof in view.

It is increasingly more important in the packaging field, for marketing reasons, for the products to be immediately recognisable by the consumers, who choose them also considering the hygienic solutions adopted for protecting the top part of the tins, where the devices for opening the tins are typically provided, as well as for covering and protecting the same against atmospheric agents.

An aim of the present invention is to guarantee the best hygienic conditions for the packaged tins, at the same time, meeting the marketing requirements referred to above.

A further aim is to provide a packaging arrangement that is simple and economically advantageous to produce and implement.

To achieve the above aims, forming the subject of the present utility model is a tin packaging arrangement according to the characteristics specified in the annexed claims, which form an integral part of the present description.

The invention concerns a tin packaging device comprising a sheet of foldable material folded around a plurality of tins arranged together in an orderly manner for the relative packaging, to form a containment volume for the tins, the volume being substantially defined by a base, a side surface, and a top cover that are obtained from one and the same continuous sheet. A peculiarity of the invention is represented by the fact that openings are provided in the top cover of the arrangement, within which top portions of the tins engage; in particular, each tin engages in a corresponding opening. In greater detail, the openings engage with a portion of the tins close to the top part thereof, in particular leaving only the respective devices for protecting a tin-opening tab or a corresponding different opening device exposed.

Advantageously, the tin packaging arrangement according to the invention guarantees an excellent seal and stability within the containment volume in so far as the tins are engaged at the top inside the sheet, at the same time, the marketing needs of the product are fully met. In fact, clear visibility of the top device for protecting the tab or other opening device, as well as of at least part of the side surfaces of the tins, is guaranteed, thus rendering the product contained in the package and the type of protection of the tab perfectly recognisable.

Another advantage is that of ensuring that the bases of the tins are protected against any possible dirt that may accumulate during storage and/or transport.

Yet a further advantage is that the package is practical, simple, and inexpensive to produce in so far as it consists simply in folding an appropriately shaped sheet provided with specific openings at the top parts of the tins.

BRIEF DESCRIPTION OF THE DRAWINGS

Further aims, characteristics, and advantages of the present invention will emerge clearly from the ensuing detailed description of some preferred examples of application, which are provided purely by way of non-limiting explanation of the present invention, with reference to the annexed drawings, wherein.

DETAILED DESCRIPTION

Figure 1:
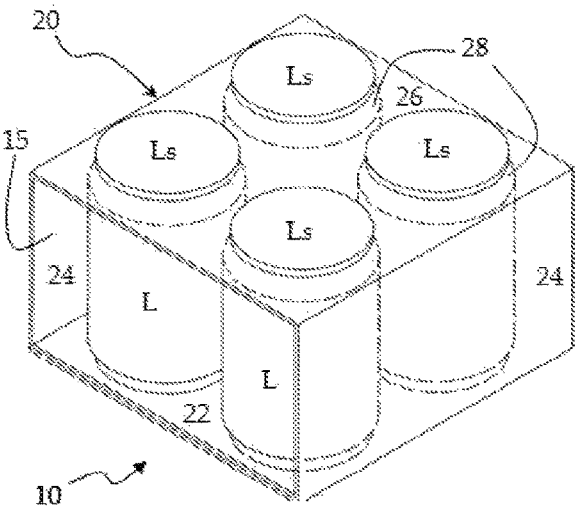
FIGS. 1 and 2 are perspective views of a first preferred embodiment and a second preferred embodiment, respectively, of a tin packaging arrangement according to the present invention, the first embodiment being characterised by a square arrangement of four tins and the second by an arrangement of two tins in a row.

With reference to the above figures, designated as a whole by 10 is a tin packaging arrangement according to the present invention, which includes a sheet of foldable material 20 folded around a plurality of tins L arranged together in an orderly manner for the relative packaging to form a containment volume 15 for the tins L. The containment volume 15 is substantially defined by a base 22, a side surface 24, and a top cover 26, which are obtained from the foldable sheet 20 in a continuous way at the moment when it is folded so as to adhere to the group of tins L arranged together in an orderly manner in contact with sheet 20. Adherence of the sheet 20 to the tins L is typically obtained via a process for folding the sheet, in machinery specifically designed for the packaging process, the sheet 20 typically being stapled or glued at its ends at the end of the corresponding folding operations, so as to define the said volume.

Openings 28 are made in the top cover 26 of the sheet 20, in which advantageously top portions of the tins L close to their respective top part Ls engage. In this way, the tins L are perfectly positioned within the containment volume 15 so that they are stably assembled together for possible transport and storage of the arrangements 10 in the warehouse.

Figure 2:
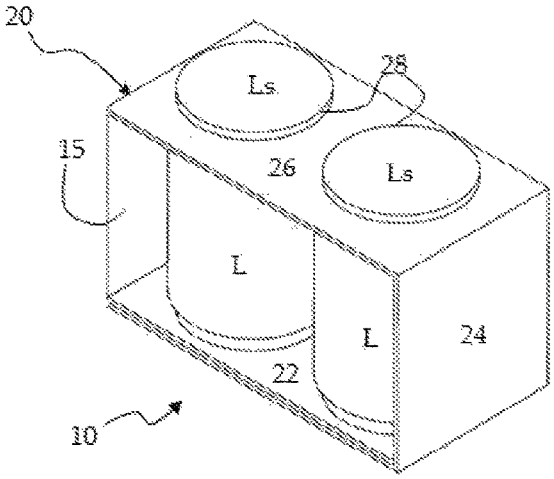
Figure 5:
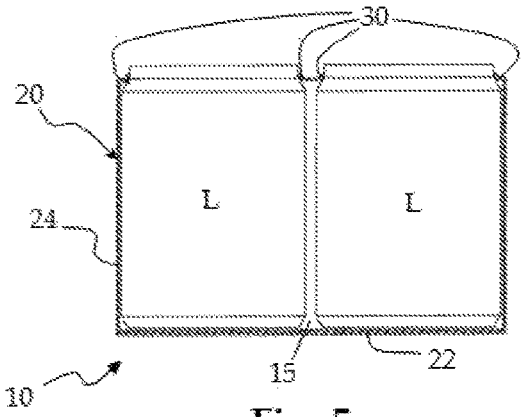
FIGS. 5 and 6 illustrate, respectively, a side elevation and a top plan view of a variant to the arrangement of FIG. 2 according to the invention.
Figure 3:
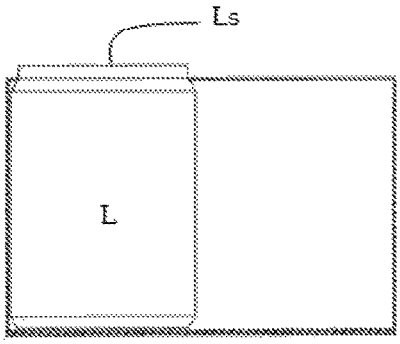
FIGS. 3 and 4 show, respectively, a side elevation and a top plan view of the arrangement of FIG. 2 in the configuration with just one tin present inside it.

With particular reference to FIGS. 1, 2, and 5, each tin L engages in a corresponding opening 28, thus advantageously stabilising all the tins comprised in the containment volume 15. In greater detail, the openings 28 engage with a portion of the tins L close to the top part Ls thereof, in particular leaving only the respective devices for protecting a tin-opening tab or other opening device exposed.

Figure 6:
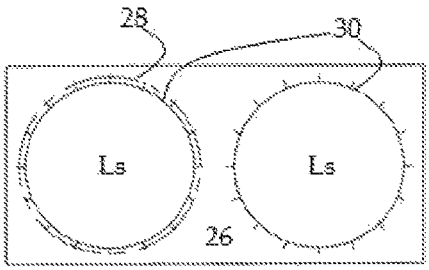
Figure 4:
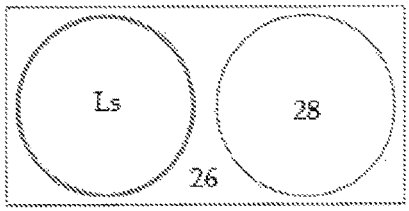

With reference to the variant of FIGS. 5 and 6, a tin packaging arrangement 10 is provided, in the top cover 26, with retention means 30 associated with the opening 28, which are designed to hold the tins L in a pre-set position and prevent exit thereof from above. In greater detail, the aforesaid retention means comprise a border 30 with radial slits formed on the edge of each individual opening 28 and designed to define a hole of a diameter slightly smaller than the diameter of the tin L that engages inside the hole, in such a way that the borders 30 with slits rise when the top cover 26 is folded down to intercept the tins L to package them during the process of assembly of the packaging arrangement 10, thus holding the respective tins L in position.

Advantageously, the retention means 30 guarantee an even more stable positioning of the tins L within the containment volume 15.

In a variant (not illustrated) of the tin packaging arrangement according to the invention, the sheet of foldable material folded around a plurality of tins to form substantially a base, a side surface, and a top cover, is provided, on its outside, with a transparent film, typically of soft and strong plastic material, which substantially coves the entire sheet. In greater detail, the transparent film substantially covers the entire containment volume defined by the folded sheet itself.

Advantageously, use of the transparent film renders the packaging arrangement even more compact and secure, hence further preventing the tins from moving inside the containment volume and rendering the packaging arrangement as a whole sturdier and more resistant to possible stresses, and substantially making it impossible for the tins to drop out.

It is clear that further variations may be made by a person skilled in the branch to the tin packaging arrangement according to the present invention, as likewise clear is that in its practical embodiment the items illustrated may have different shapes and may be replaced by technically equivalent elements.

For example, the arrangement of the tins may be extremely varied; for example, they may be arranged in rows of three or more or else form a row or a plurality of rows.

The invention claimed is:

1. A tin packaging arrangement comprising a sheet of foldable material folded around a plurality of tins arranged together in an orderly manner for the relative packaging, to form a containment volume for the tins, said volume being substantially defined by a base, a side surface, and a top cover obtained from said sheet in a continuous way, said arrangement being characterised in that the top cover of the sheet of the packaging arrangement is configured to define one or more openings configured to engage with top portions of said tins, wherein the top cover of the sheet further comprises retention means associated with each of the one or more openings, the retention means being configured to hold the tins in a pre-set position and prevent exit of the tins from within the containment volume from above; and wherein said arrangement further comprises a transparent film configured to cover the entirety of the sheet of foldable material and the entirety of the containment volume so as to render the arrangement compact and secure via further preventing the tins from moving inside the containment volume and via increasing the sturdiness and resistance to stress of the arrangement.

2. The tin packaging arrangement according to claim 1, characterised in that each packaged tin engages in a corresponding opening in the top cover of the sheet.

3. The tin packaging arrangement according to claim 1, characterised in that it comprises, in the top cover of the sheet, retention means associated with the opening, designed to hold the tins in a pre-set position and prevent exit thereof from above.

4. The tin packaging arrangement, according to claim 1, characterised in that the retention means comprise a border with radial slits, which is obtained on an edge of an individual opening and is designed to define a hole of a diameter slightly smaller than the diameter of the tin L that engages inside the hole.

* * * * *